US005755497A

United States Patent [19]

Chang

[11] Patent Number: 5,755,497

[45] Date of Patent: May 26, 1998

[54] COMPACT DISK STORAGE COMPARTMENT OF COMPUTER CASES

[76] Inventor: I-Chen Chang, 2F, No. 41, Maan-Pyng St., Pan-Chyau Shih, Taipei Hsien, Taiwan

[21] Appl. No.: 823,136

[22] Filed: Mar. 25, 1997

[51] Int. Cl.[6] ..... A47B 81/06

[52] U.S. Cl. ..... 312/223.2; 312/9.46; 361/683

[58] Field of Search ..... 312/223.2, 9.41, 312/9.43, 9.53, 9.55; 361/683, 724, 727

[56] References Cited

U.S. PATENT DOCUMENTS

| | | | |
|---|---|---|---|
| 1,262,789 | 4/1918 | Heller | 312/9.43 |
| 4,647,118 | 3/1987 | Kamperman | 312/9.43 |
| 4,837,590 | 6/1989 | Sprague | 361/727 |
| 5,549,375 | 8/1996 | Pagliaccio | 312/223.2 |
| 5,586,003 | 12/1996 | Schmitt et al. | 361/683 |
| 5,587,877 | 12/1996 | Ryan et al. | 312/223.2 |

*Primary Examiner*—Peter M. Cumom
*Assistant Examiner*—Gordon A. Anderson
*Attorney, Agent, or Firm*—Bacon & Thomas

[57] ABSTRACT

A compact disk storage compartment is mounted in a opening of a front panel of a computer case. The compartment exterior and front panel peripheral rims have engaging means. The compartment has a cover connected to a sliding base plate and a disk rack mounted on the base plate for slidably supporting a plurality of disks.

6 Claims, 9 Drawing Sheets

COMPACT DISK STORAGE COMPARTMENT OF COMPUTER CASES

BACKGROUND OF THE INVENTION

The present invention relates to a compact disk storage compartment associated with a front panel of a computer case, especially to a compact disk storage compartment associated with a front panel of a computer case that provides room for housing and grouping 3½ inch-sized compact disks and that is featured by two different travelling distances to facilitate the retrieval of compact disks.

Along with the advance of computer technologies, the personal computers most widely used have changed from those of the 80386 and the 80486 types to those of the Pentinum type and the multimedia type as well as the upgrade of peripheral equipment. Compact disks can store massive data and are easy to carry. Thus compact disks are broadly accepted as a major tool to keep information in a computer file form. However, on the contrary, the convenience in carrying means it is easy to miss. How to keep compact disks safe and provide convenience in use has become users' important consideration. At present there are many kinds of compact disk storage boxes on the market. These are mostly of an independent form and their design does not consider space saving and convenience in use.

Accordingly the primary object of the present invention is to provide a compact disk storage compartment associated with a front panel of a computer case that is housed inside the lower portion of the computer case and that can allow users to arrange and retrieve compact disks by opening the front cover of the inventive compartment without keeping and handling trivial plastic cases or heavy storage boxes. It has the advantages of saving space for the use of other peripheral equipment and providing convenience in the operation of computers.

To obtain the above objects, the invention contains a front panel of a computer case having an opening equipped with barbed fingers. The invention is further completed with an enclosure, link systems, a base plate, and a compact disk rack. In the inventive construction, the front cover of the enclosure is provided with a handle on the front face thereof to make it easy to open, and a first fixed rod of a link system on the back face that can drive the link system and a second fixed rod of the base plate to forward the base plate when opening the front cover. The front cover is furnished with protrusions on its two sides, by which the cover is pivotally joined with the enclosure. The enclosure includes rails on the internal side walls to guide the motion of the base plate. The internal side walls of the enclosure are provided with pin holes near the corners thereof that couple with the protrusions of the front cover. In addition, there are lugs provided on the exterior walls of the enclosure to join with the front panel of the computer case.

Two link systems respectively consist of a first fixed rod attached to the front cover, a second fixed rod attached to the base plate, and a link connecting the first fixed rod and the second fixed rod. The first fixed rod and the second fixed rod respectively has a pin hole. Two pins on opposite ends of the link individually extend into the pin holes of a first fixed rod and of a second fixed rod to pivotally join two fixed rods in order that the movement of the front cover of the enclosure can drive the base plate backward and forward. The base plate is equipped with first raised guide blocks, locating fingers, and second fixed rods. The first raised guide blocks and the locating fingers are engaged with a compact disk rack and rails on the internal side wall of the enclosure. The compact disk rack is also provided with second raised guide blocks and locating stop blocks on the bottom. The rack can be of an open form with guide slots. However, it can also adopt a drawer form. Because that the base plate comprises first raised guide blocks and locating fingers, it enables the compact disk rack to be further pulled out. Thus the compact disk rack can reach a farther position to facilitate the retrieval of compact disks.

BRIEF DESCRIPTION OF THE ACCOMPANYING DRAWINGS

The detailed structure and features of the invention will become apparent from the following description of preferred embodiments when read with reference to the accompanying drawings, in which.

Figure 1:
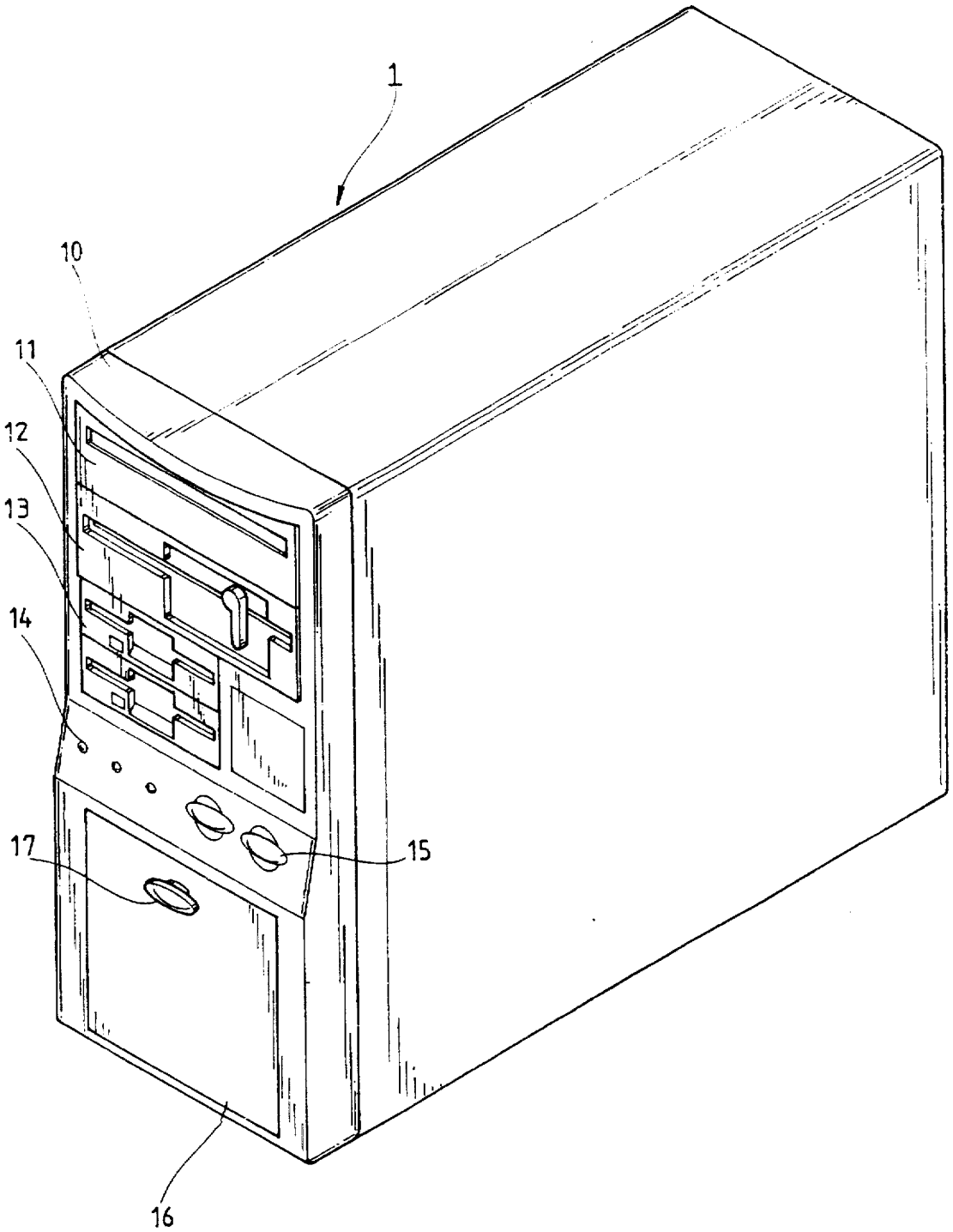
FIG. 1 shows the outer appearance of a computer case that is equipped with a compact disk storage compartment of the invention.
Figure 2:
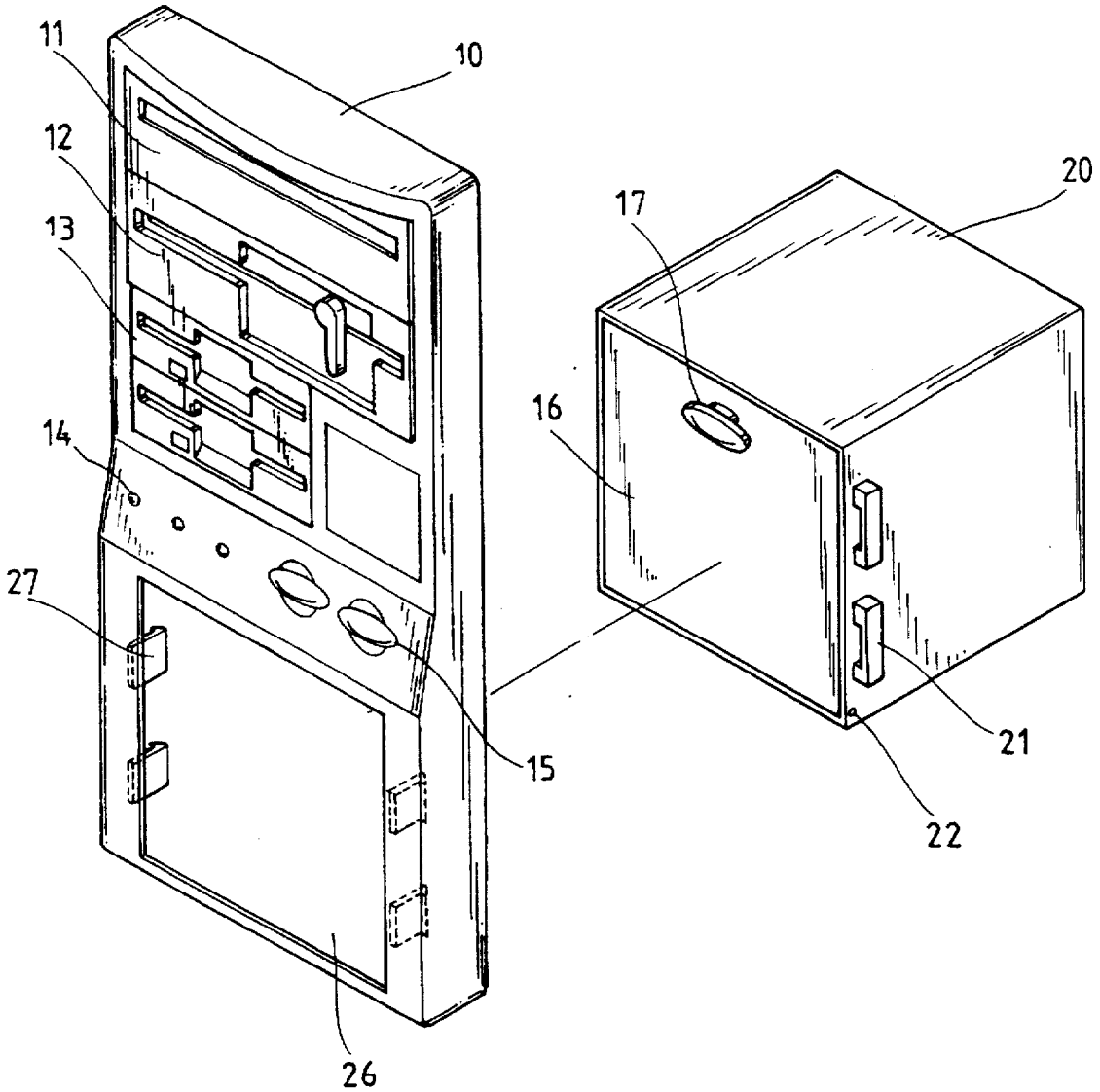
FIG. 2 illustrates how a compact disk storage compartment of the invention couples with the front panel of the computer case of FIG. 1.
Figure 3:
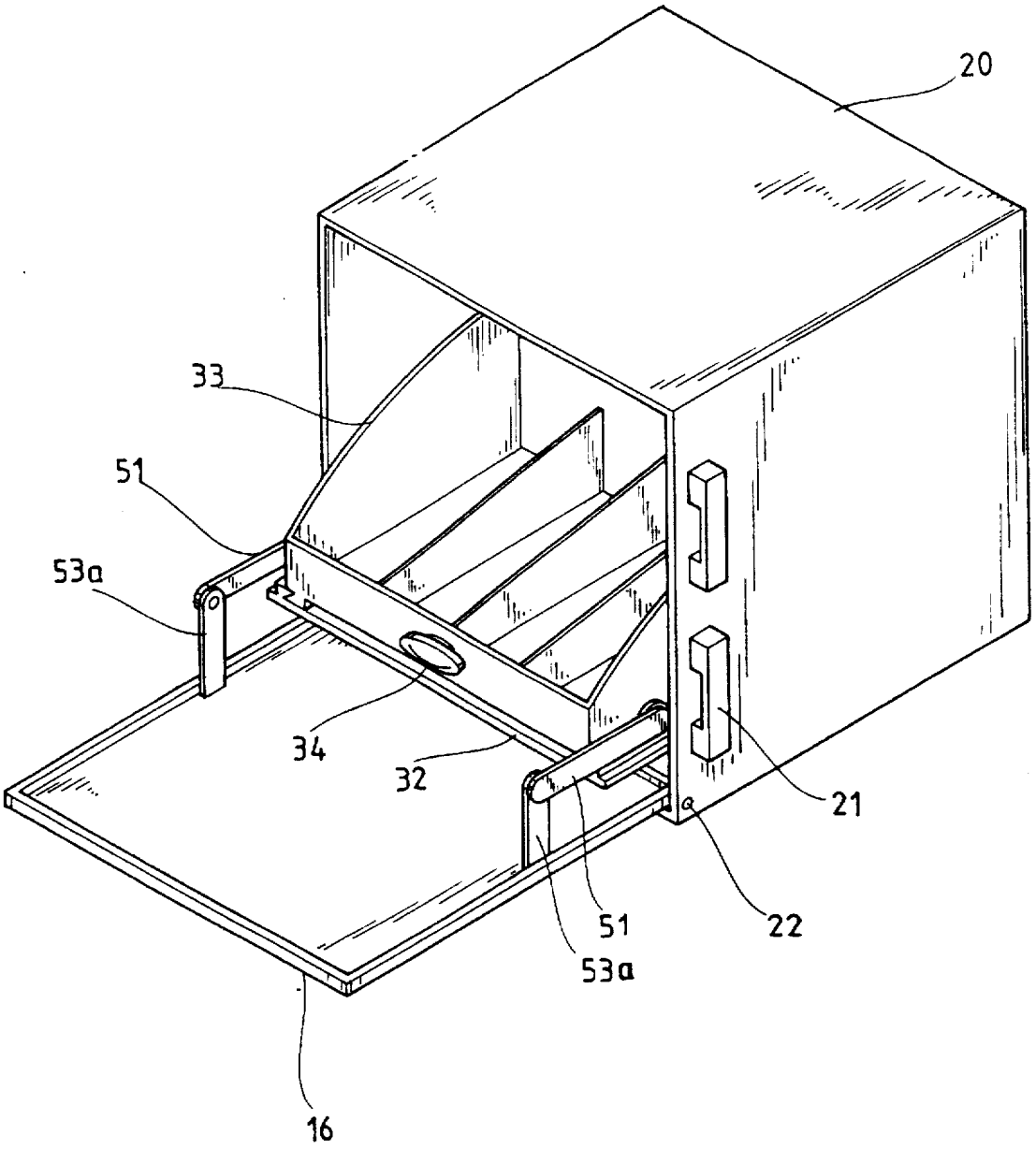

FIG. 3 perspectively shows the interior of a compact disk storage compartment of the invention.

Figure 4:
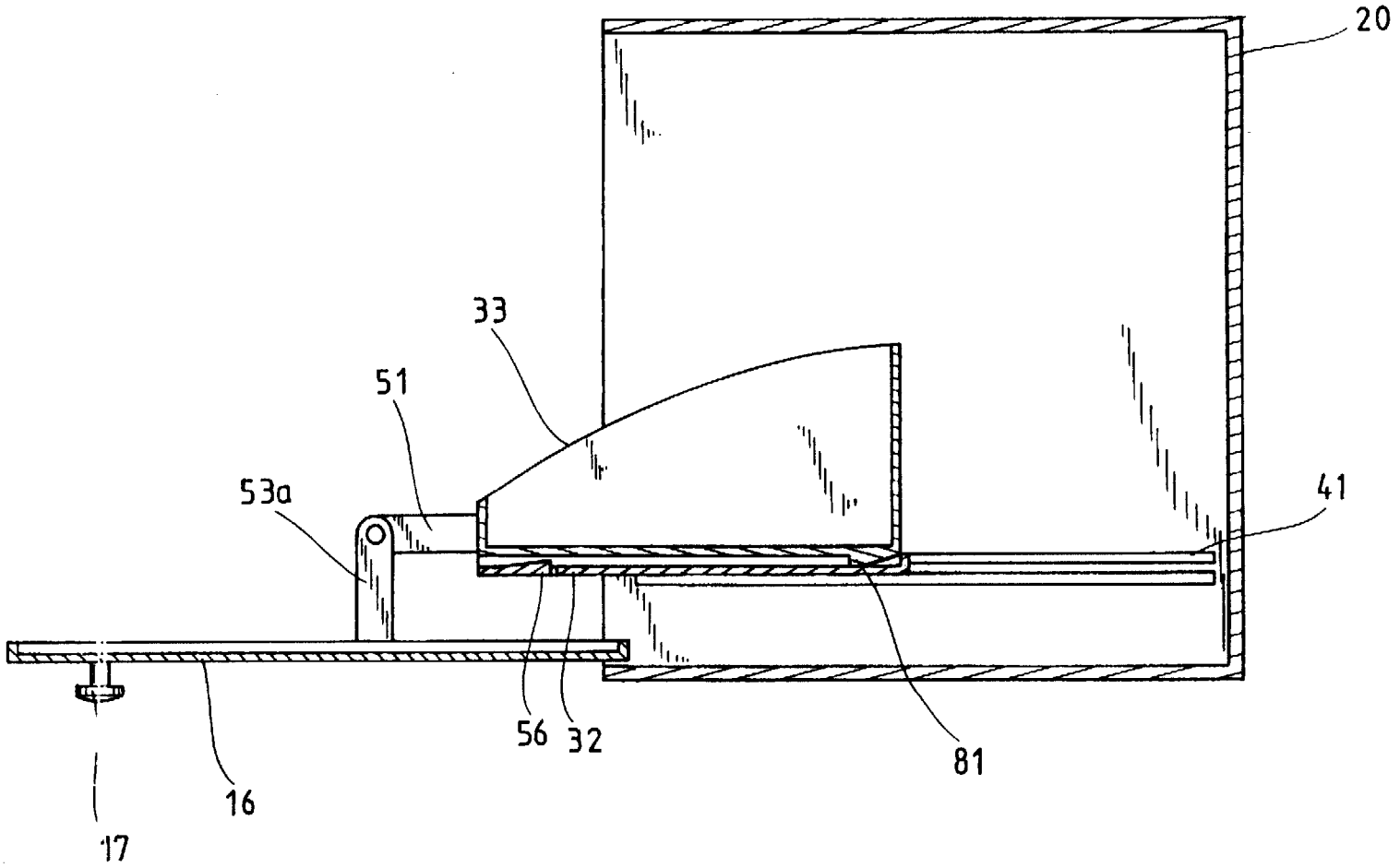

FIG. 4 is a side view of the compact disk storage compartment of FIG. 3.

Figure 5:
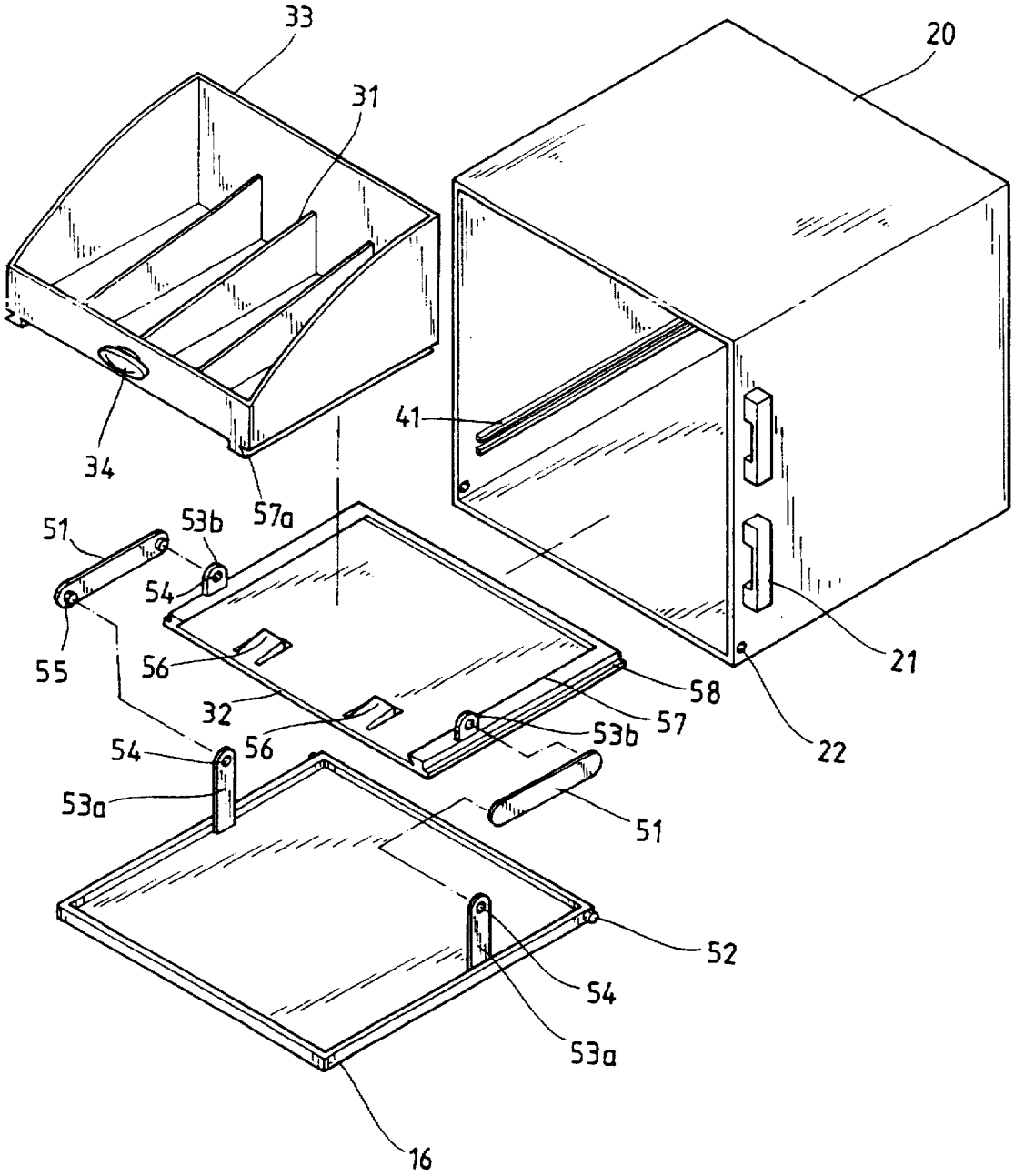

FIG. 5 explosively depicts the parts of the compact disk storage compartment of FIG. 3.

Figure 6:
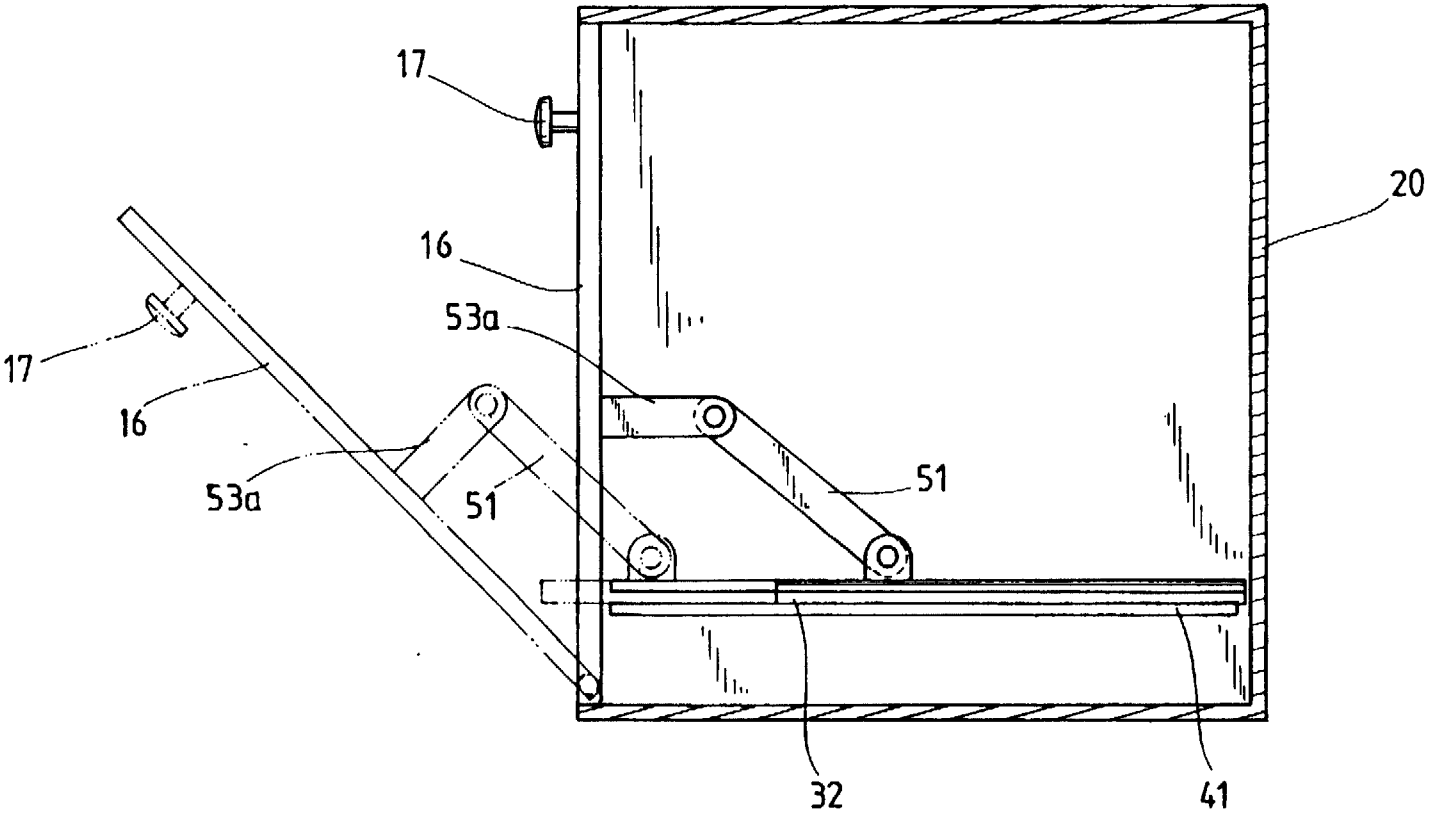
Figure 7:
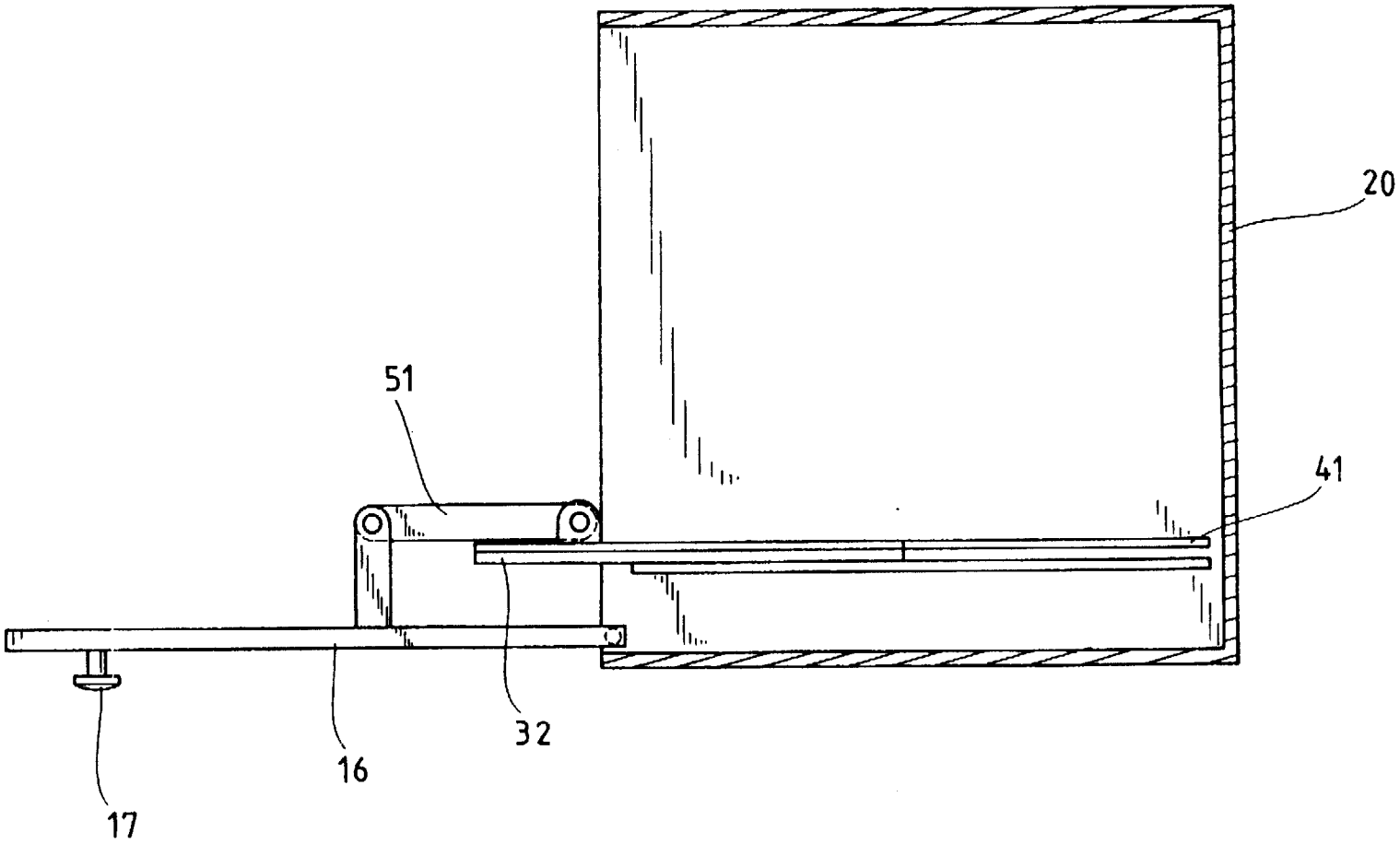

FIGS. 6 and 7 show the consecutive movements of the front cover of the storage compartment when the cover is opened.

Figure 8:
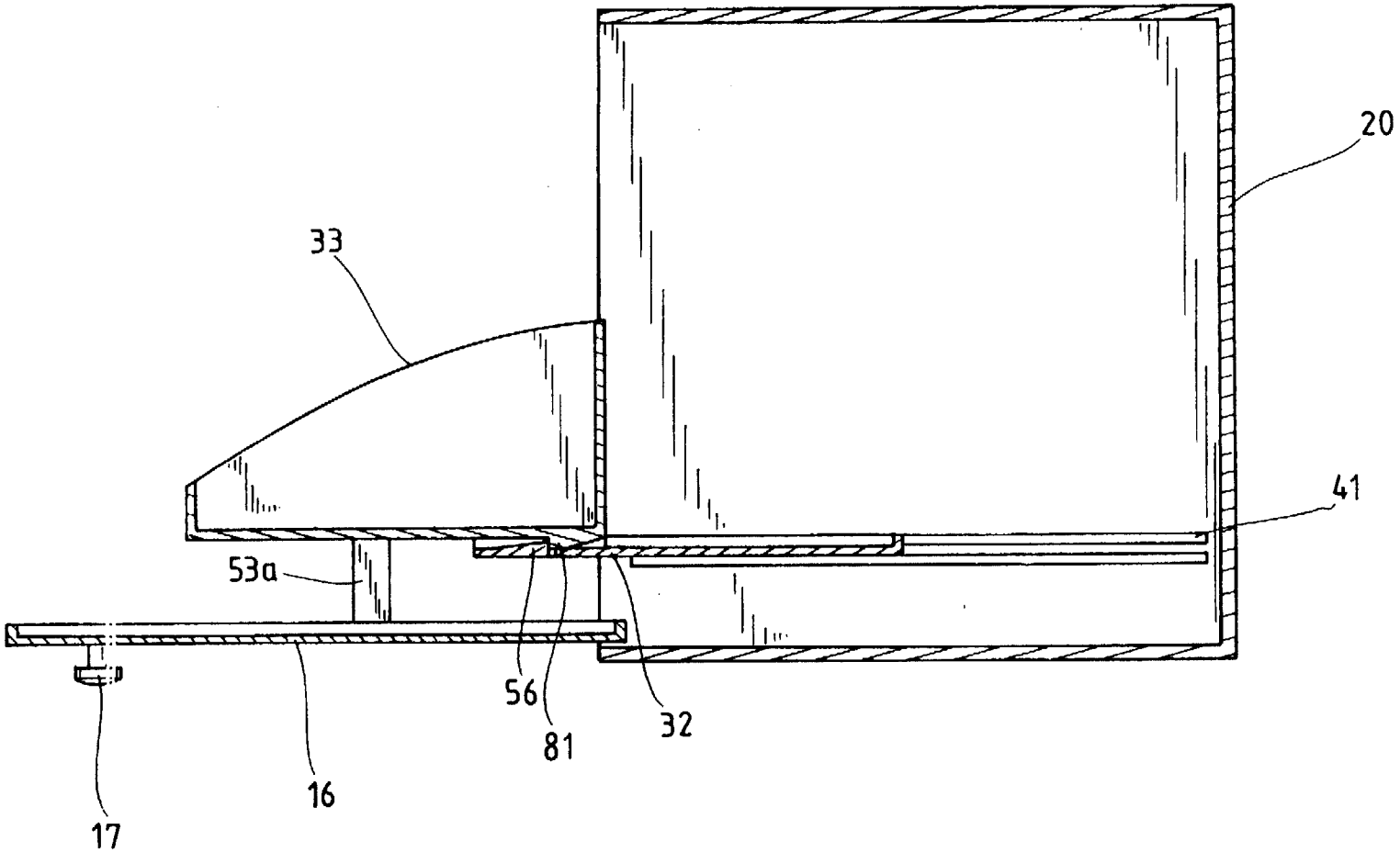

FIG. 8 shows a state in which a compact disk rack is pulled out from the storage compartment of the invention and stays on a base plate.

Figure 9:
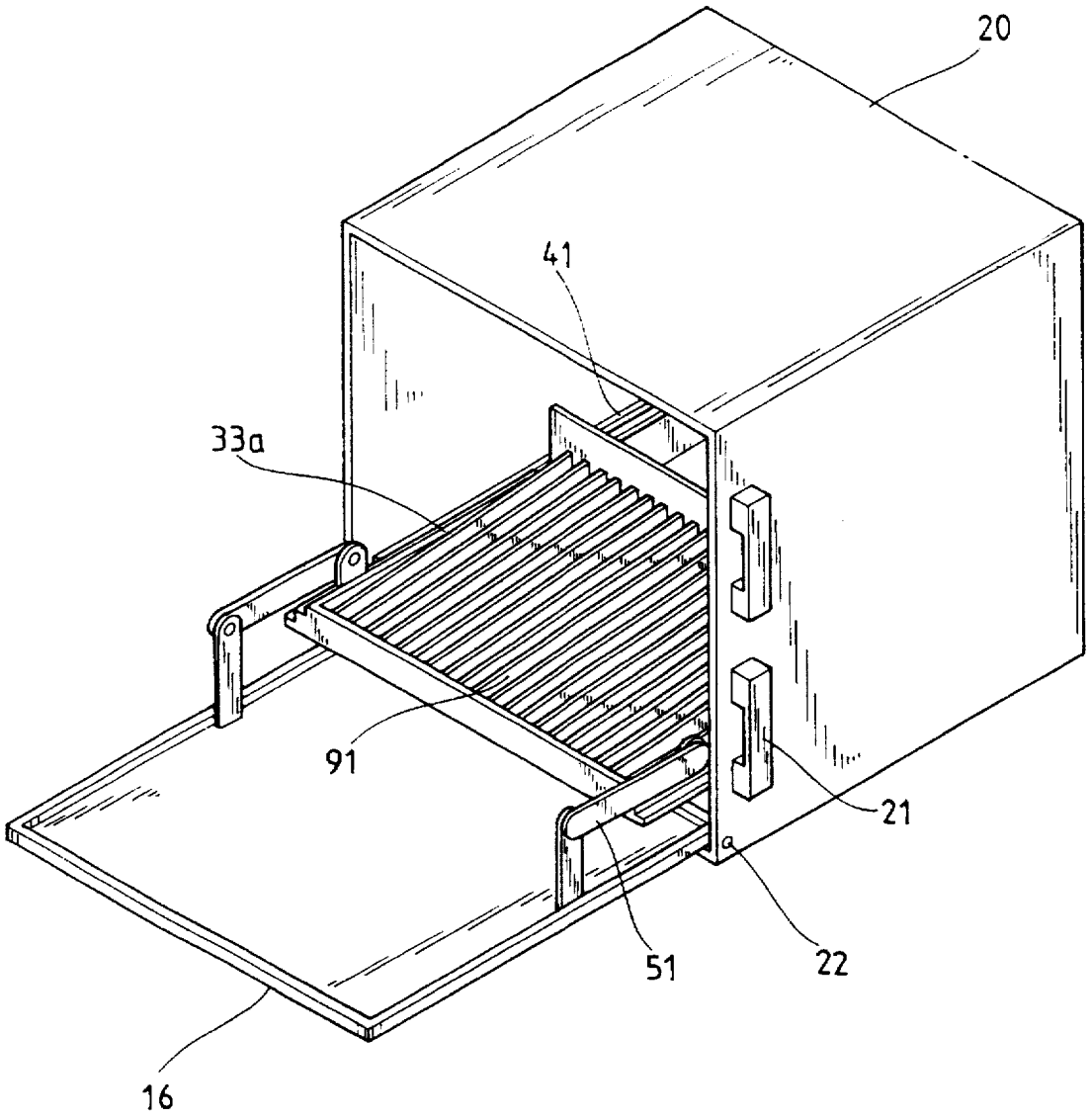

FIG. 9 shows another embodiment of a compact disk storage compartment of the invention.

DETAILED DESCRIPTION OF PREFERRED EMBODIMENTS

With reference to FIGS. 1 through 5, a compact disk storage compartment structure according to the invention generally includes a front panel 10 of a computer case, an enclosure 20, a compact disk rack 33, links 51, and a base plate 32.

The front panel 10 is provided with a first slot 11 for receiving a compact disk driver, a second slot 12 for a 5¼ inch floppy disk driver, a third slot 13 for a 3½ inch compact disk driver, indicator lights 14, and functional buttons 15. It further incorporates a square opening 26 that is equipped with barbed fingers 27 on the back side of the panel. These fingers are symmetrically arranged either on the upper and the lower rims of the opening 26 or the left and the right rims.

The enclosure 20 is a box equipped with a front cover 16 and recessed pin holes 22 symmetrically formed on the side walls near the open end. These pin holes, in cooperation with protrusions 52 of the front cover 16, serve as the fulcrum points when the front cover turns. The pin holes 22 may be arranged on the top, the bottom, or the left and the right side of the box if desired. Accordingly, the storage compartment of the invention can be opened either by turning the cover upside down or from the left to the right. FIG. 3 illustrates an example of a storage compartment that can be opened by turning down its front cover. The exterior wall of the enclosure is symmetrically provided with lugs 21 corresponding to the barbed fingers 27 of the front panel 10 in position. Rails 41 are provided on the interior side walls of the enclosure for guiding the motion of the base plate 32.

Referring to FIGS. 5 through 7, the linkage consists of two first fixed rods 53*a* attached to the front cover 16, two second fixed rods 53*b* attached to the base plate 32, and the links 51 each connecting a first fixed rod to a second fixed rod. The first and the second fixed rods respectively have a pin hole 54 and the link 51 has two pins 55. By means of pivotally coupling the pin with the pin hole, the link 51 can move the base plate 32 along the rails when opening or closing the front cover.

The base plate 32 has first raised guide blocks 57 provided on two sides, locating fingers 56 in the front, and two second fixed rods 53*b*. It is further provided with guide grooves 58 on two side edges for the engagement with the rails 41 of the enclosure 20. The compact disk rack 33 comprises second raised guide blocks 57*a* formed on its bottom face along two side edges thereof and locating stop blocks 81 arranged near its rear end. With help of an engagement of the second raised guide blocks 57*a* with guide grooves 58 and a cooperation of the locating fingers 56 with the stop blocks 81, the compact disk rack 33 can slide over the base plate 32.

Refer to FIG. 9 where another embodiment of a storage compartment according to the invention is shown. In this embodiment, the 3½ inch compact disk rack 33*a* is configured to have a low back wall and a plurality of arrangement slots 91 or it can be of a drawer form as shown in FIG. 3. This kind of the rack 33 includes a plurality of partition walls 31 to provide convenience in grouping disks. With the aids of first raised guide blocks 57 and locating fingers 56 the drawer type disk rack 33 can be further pulled out by means of a handle 34 to make the placement or retrieval of disks easier. A compact disk rack 33*a* having arrangement slots 91 can adopt a similar structure as the base plate 32, having second fixed rods 53*b* and guide grooves 58 provided on the side edges. The disk rack 33*a* has a back wall higher than other portions in order to keep disks on it from dropping out from the rear end.

From the above description, the compact disk storage compartment according to the invention can be joined with a computer case and it enables users, from the front panel of the computer, to operate the cover of the compartment and pull out the disk rack to facilitate the handling of compact disks by means of a link system. Such a novel design has never been seen in the industry and it has the following advantages of:

Having a novel originative aesthetic front panel, providing convenience in the placement and retrieval of compact disks, Saving money that would be spent in buying another compact disk storage case, and Saving space for the use of other computer peripheral equipment.

In summary, the storage compartment of the invention can indeed achieve the aforesaid objects. It is valuable in the industry.

What is claimed is:

1. A compact disk storage compartment associated with a front panel of a computer case comprising:

a front panel of a computer case including a square opening and opening peripheral rims with barbed fingers on a back side of the panel;

an enclosure having an openable front cover with a handle, two rails formed on internal side walls of the enclosure, to a base plate sliding on said internal rails, and two lugs each symmetrically provided on exterior side walls of the enclosure in a position corresponding to said barbed fingers of said front panel;

said base plate equipped with first raised guide blocks, locating fingers, and second fixed rods; said first raised guide blocks and said locating fingers being individually engaged with second raised guide blocks and locating stop blocks of a compact disk rack respectively;

two link systems each consisting of a first fixed rod attached to said front cover, a second fixed rod attached to said base plate, and a link connecting the first fixed rod and the second fixed rod, said first fixed rod and said second fixed rods respectively having a pin hole and said link having two pins rotatably extending into the pin holes of said first fixed rod and said second fixed rod;

and characterized in that said front panel couples with said enclosure by means of an engagement between said barbed fingers and said lugs to hold said enclosure in said square opening in order that users can open the front cover to pull out said base plate and said compact disk rack.

2. A compact disk storage compartment associated with a front panel of a computer case as claimed in claim 1, wherein said barbed fingers formed on the back side of the panel along the rims of said opening are symmetrically distributed.

3. A compact disk storage compartment associated with a front panel of a computer case as claimed in claim 1, wherein said front cover is equipped with means for opening the compact disk storage compartment by turning down the cover.

4. A compact disk storage compartment associated with a front panel of a computer case as claimed in claim 1, wherein said front cover is equipped with such means that the compact disk storage compartment can be opened by turning the cover either from the left to the right or from the right to the left.

5. A compact disk storage compartment associated with a front panel of a computer case as claimed in claim 1, wherein said base plate is associated with said compact disk rack by means of an engagement of said raised guide blocks and said guide grooves and a cooperation of said locating finger with said stop blocks.

6. A compact disk storage compartment associated with a front panel of a computer case as claimed in claim 1, wherein said compact disk rack is configured to be a tray with a plurality of arrangement slots.

* * * * *